US005450301A

United States Patent [19]

Waltz et al.

[11] Patent Number: 5,450,301

[45] Date of Patent: Sep. 12, 1995

[54] LARGE SCALE DISPLAY USING LEDS

[75] Inventors: Thomas M. Waltz, Newtown; Alfred Dagenais, Norwalk, both of Conn.

[73] Assignee: Trans-Lux Corporation, Norwalk, Conn.

[21] Appl. No.: 131,895

[22] Filed: Oct. 5, 1993

[51] Int. Cl.[6] ..... G09F 13/00

[52] U.S. Cl. ..... 362/231; 362/800; 362/812; 40/544; 40/581; 340/815.45; 340/815.65; 345/83

[58] Field of Search ..... 362/231, 800, 812; 40/544, 581; 340/815.45, 815.65; 345/82, 83

[56] References Cited

U.S. PATENT DOCUMENTS 4,887,074 12/1989 Simon et al. ..... 340/815.45
5,036,248 7/1991 McEwan et al. ..... 362/800
5,184,114 2/1993 Brown ..... 345/83
5,268,828 12/1993 Miura ..... 362/812

FOREIGN PATENT DOCUMENTS 8604439 7/1986 WIPO ..... 345/83

*Primary Examiner*—Ira S. Lazarus
*Assistant Examiner*—Sara Sachie Raab
*Attorney, Agent, or Firm*—Kane, Dalsimer, Sullivan, Kurucz, Levy, Eisele & Richard

[57] ABSTRACT

A large scale display is made of several panels, each holding several display elements defined by LEDs. Preferably, each panel is arranged so that it can directly replace, both mechanically and electrically, a panel having incandescent bulbs as display elements.

2 Claims, 3 Drawing Sheets

LARGE SCALE DISPLAY USING LEDS

BACKGROUND OF THE INVENTION

1. Field of Invention

This invention pertains to large scale displays used, for example, for traffic signs, and more particularly to large scale displays which have elements selectively turned on and off to generate alphanumeric characters or graphic patterns.

2. Description of the Prior Art

Large scale displays are used for various purposes at sports stadiums, on the highways, and so on to display selected messages. Presently, there are two types of displays which are prevalent. One is an electromechanical type formed of a plurality of windows arranged in grids and small two-colored panels arranged behind the windows which can be moved to render each window either color or the other (i.e. black or amber). A disadvantage of this type of display is that since it is mechanical, it requires frequent maintenance. Moreover, at night, external lights are required to illuminate the display. The second prevalent display type consists of a plurality of incandescent bulbs arranged in preselected arrays for example 8×5. Various alphanumeric characters can be displayed in each array by selectively energizing some of the bulbs. A problem with this type of display is that the bulbs have a relatively short life and hence must be changed frequently. Another problem is that when incandescent bulbs are used, power consumption is high and excess heat is generated.

OBJECTIVES AND SUMMARY OF THE INVENTION

In view of the above-mentioned disadvantages of the prior art, it is an objective of the present invention to provide a large scale display which makes use of semiconductor-based light elements which last much longer than incandescent bulbs.

A further objective is to provide a display with light elements which are much more efficient than incandescent bulbs and hence require much less power and generate less heat.

A further objective is to provide a semiconductor based display which is made up of modules that can readily replace incandescent bulb arrays.

Other objectives and advantages of the invention shall become apparent from the following description. Briefly, a large scale display constructed in accordance with this invention consists of several boards, each board having an array of semiconductor light sources defining display elements. Advantageously, LEDs of various colors can be selected for each display element and arranged to generate a display element having a perceived color which is different from the colors of the LEDs.

DETAILED DESCRIPTION OF THE INVENTION

Figure 1:
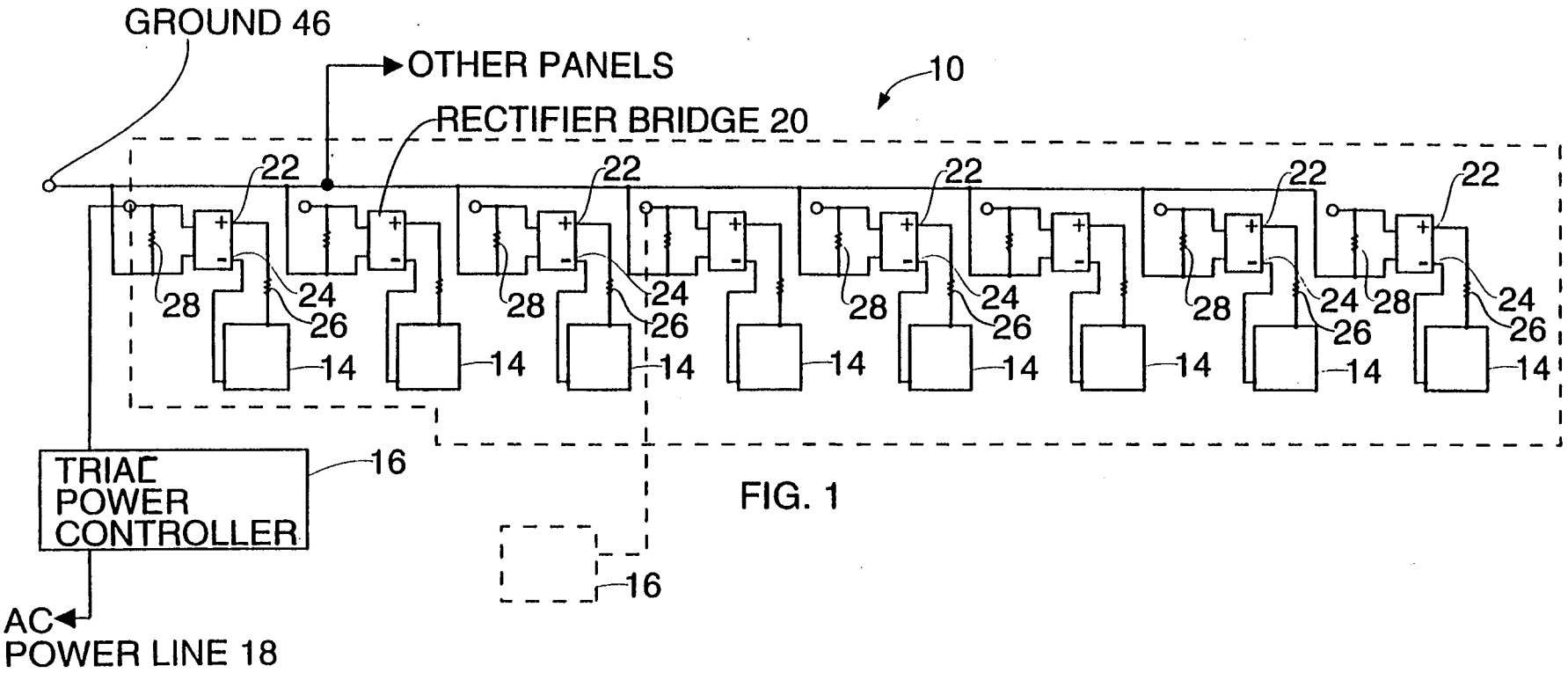
FIG. 1 shows a block diagram of a display constructed in accordance with this invention.
Figure 3:
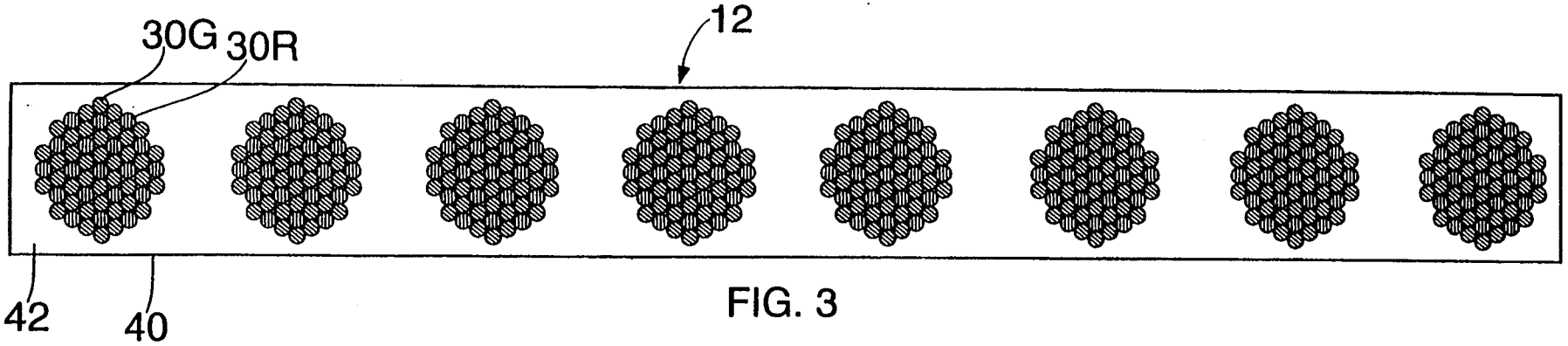
FIG. 3 shows a front view of a panel with several display elements.

Referring now to the drawings, and more particularly to FIG. 1, a display 10 constructed in accordance with this invention consists of several panels 12. Each panel 12 consists of a plurality of display elements 14. In FIGS. 1 and 3, the panel 12 has eight display elements 14. A triac power controller 16 is provided to activate each display element 14. (In FIG. 1 only a single controller 16 is shown for the sake of clarity, however it should be understood that each display element 14 is coupled to an identical power controller as described below). Controller 16 receives power for the respective display element 14 from an AC line 18. The AC output of the power controller is rectified by a full wave rectifier bridge 20. The bridge 20 generates a corresponding DC voltage on its output terminals 22 and 24 which feed to the display 14 through a series resistor 26.

Additionally, a resistor 28 is coupled in parallel to the output of the triac power controller to draw a small holding current for the triac power controller 16.

Figure 2:
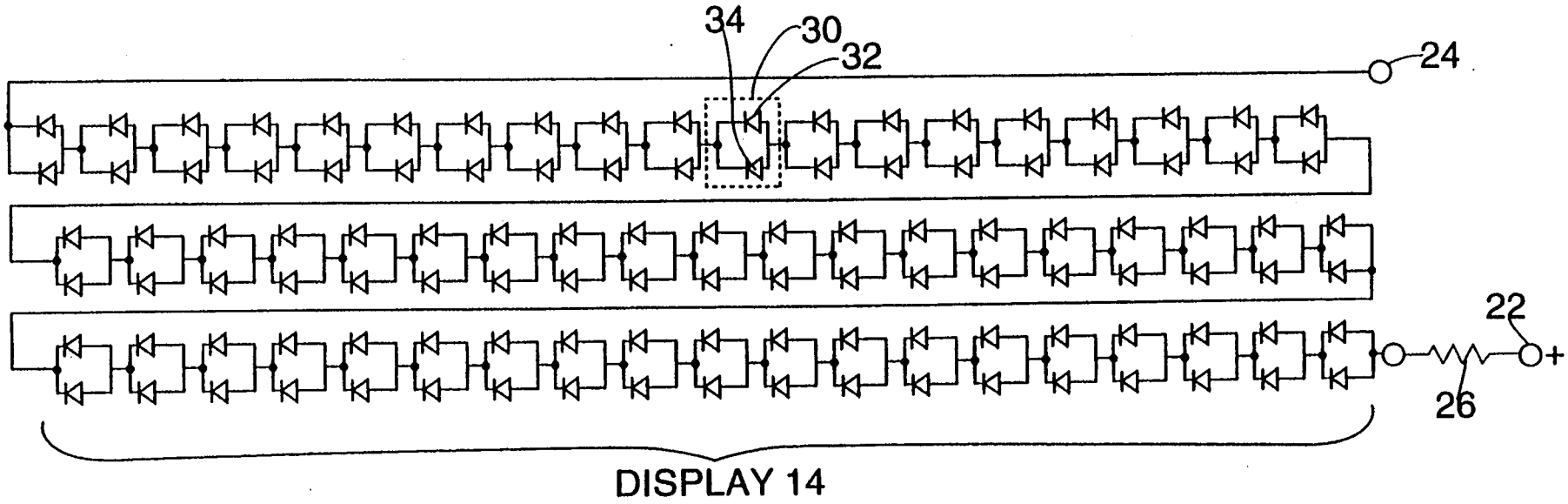
FIG. 2 shows a schematic diagram of the LEDs for the display elements of FIG. 1.

As shown in more detail in FIG. 2, display 14 consists of a plurality of LED assemblies 30, each diode assembly 30 consisting of two diodes 32, 34 connected in parallel in the same direction. In FIG. 2, the display element 14 consists of 57 diode assemblies 30. The LED assemblies 30 are connected in series and are coupled to the positive terminal 22 through resistor 26 and to the negative terminal 24 as shown. In operation, each of the diodes of a display elements 14 is simultaneously energized through the triac power controller 16. Controller 16 can turn all of the diode assemblies 30 fully on, or they can be set to a partial brightness as required. The current from the controller flows through the rectifier 20, terminal 22, resistor 26, the diodes 32, 34 and back to terminal 24 and the common ground 46. The current through diodes 32, 34 is limited by resistor 26.

Figure 4:
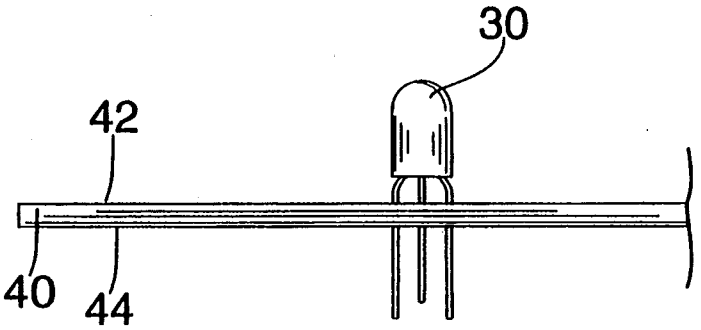
FIG. 4 shows an enlarged partial cross-sectional view of the panel of FIG. 3.

Referring now to FIGS. 3 and 4, each panel 12 further consists of a board 40 having two opposed faces 42, 44. The LED assemblies are mounted on face 42 while the remaining electrical components (i.e. the resistors 26, 28 and the rectifier bridge 20) can be mounted on face 44. Preferably, the LED assemblies 30 are closely packed and arranged in a substantially circular pattern to define a respective display element 14. In FIG. 3, an array of 1×8 display elements 14 is shown. In this configuration, panel 12 can be made to the same dimensions and the same electrical requirements and connections as a standard panel having an array of 1×8 incandescent bulbs. Various regulatory authorities have prescribed that large scale display panels have certain formats. For example, the State of California has mandated that incandescent highway signs must be made of five replaceable sections of eight incandescent bulbs each for a total for 40 display elements. This standard can be met by using five panels 12 such as illustrated in FIG. 3, each panel electrically and mechanically replacing a respective panel of incandescent bulbs.

The LEDs 32, 34 come in various colors, however, green and red LEDs generate the most intensity. Some large scale displays are required to have characters of a certain color. If red or green display elements are required, then of course all the LEDs of a display element will have that color. However, in many instances, the display element must be amber. Such a display element may be generated by using both red and green assemblies closely packed together. It has been found that good results are obtained if the ratio of red to green assemblies is 1:2. Thus, an amber display element consisting of 57 assemblies should include 19 red LED and 38 green LED assemblies. As shown in FIG. 3, the assemblies 30 can be arranged so that except at the edges of the pattern (FIG. 3) every red assembly 30R is surrounded by six green assemblies 30G. In this manner, when the display 14 is on, a person looking at it from a distance will perceive it as an amber display element even though it is made of red and green LED assemblies 30R, 30G wherein a red assembly 30D consists of two red LEDs and a green assembly 30G consists of two green LEDs.

As previously mentioned, the panels 12 can be made to directly replace mechanically and electrically panels of incandescent bulbs. However, because panels 12 have display elements made of LED assemblies, they are will last much longer before requiring maintenance since LEDs have much longer life than incandescent bulbs. In addition, the panels require less power and generate virtually no heat while generating substantially the same amount of light as the incandescent bulbs.

Obviously, numerous modifications may be made to this invention without departing from its scope as defined in the appended claims.

I claim:

1. A large scale display comprising:

a plurality of panels, each panel having a plurality of display elements, said panels being constructed and arranged to form a rectangular array defined by said display elements;

wherein each display element includes a plurality of LED diodes arranged in a preselected pattern on a respective panel;

wherein at least one of said display elements includes a first set of diodes emitting red light and a second set of diodes emitting green light, said first and second sets of diodes cooperating to allow said display to be perceived as amber; and wherein at least one of said diodes emitting red light is surrounded by and in contact with six diodes emitting green light.

2. A replacement panel for incandescent bulb display panels, said replacement panel comprising;

a board;

a plurality of display elements mounted on said board, wherein each display element includes a plurality of LED diodes arranged in a preselected pattern on a respective panel;

wherein at least one of said display elements includes a first set of diodes emitting red light and a second set of diodes emitting green light, said first and second sets of diodes cooperating to allow said display to be perceived as amber; and wherein at least one of said diodes emitting red light is surrounded by and in contact with six diodes emitting green light.

* * * * *